US006435248B1

(12) United States Patent
Masumoto

(10) Patent No.: US 6,435,248 B1
(45) Date of Patent: Aug. 20, 2002

(54) APPLICATOR FOR TRANSFERRING A TRANSFER TAPE TO A SUBSTRATE SURFACE

(75) Inventor: Hiroaki Masumoto, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 77 days.

(21) Appl. No.: 09/712,255

(22) Filed: Nov. 15, 2000

(30) Foreign Application Priority Data

Nov. 15, 1999 (JP) ..... 11-324313

(51) Int. Cl.[7] ..... B32B 31/00

(52) U.S. Cl. ..... 156/577; 156/579; 118/76; 118/257; 242/160.4; 242/171; 242/588.6

(58) Field of Search ..... 156/238, 523, 156/527, 540, 574, 577, 579; 242/160.2, 160.4, 170, 171, 588, 588.2, 588.3, 588.6; 255/46; 118/76, 200, 257

(56) References Cited

U.S. PATENT DOCUMENTS 4,853,074 A * 8/1989 Manusch et al. ..... 156/577

6,321,815 B1 * 11/2001 You ..... 118/76

FOREIGN PATENT DOCUMENTS

| | | |
|---|---|---|
| EP | 0 742 111 | 11/1996 |
| JP | 7-41732 | 4/1994 |

* cited by examiner

*Primary Examiner*—Mark A. Osele
(74) *Attorney, Agent, or Firm*—Birch, Stewart, Kolasch & Birch, LLP

(57) ABSTRACT

An applicator for transferring a transfer material like a correction paint or paste from a transfer tape to a substate surface comprises an elastic tongue piece 8 having a tip 8' as part of a transfer head 7. The tip 8' has a curved discharge or downstream surface 10 whose radius of curvature is between 0.75 and 1.5 mm and a curved transfer or upstream surface 11 whose radius of curvature is between 1.5 and 2.5 mm. Both of these curved surfaces 10 and 11 are connected with each other to provide a large transferring surface 12 which ensures that the transfer material can properly be transferred onto a substrate surface over a wide range and that the transfer tape can pass the tip in a smooth and continuous manner.

3 Claims, 3 Drawing Sheets

APPLICATOR FOR TRANSFERRING A TRANSFER TAPE TO A SUBSTRATE SURFACE

BACKGROUND OF THE INVENTION

1. Field of the Invention

The present invention relates to an applicator for transferring a transfer material like a correction paint or a paste applied to a surface of a transfer tape to a substrate surface in order to correct an error in writing, etc. or effect a bonding, and especially to a transfer head as a part of the applicator.

2. Description of the Related Art

A conventional applicator of a type referred to above comprises an elastic tongue piece for pushing and closely contacting not-yet-used transfer tape onto a substrate surface from behind, and guide plates for regulating a fluctuation of the transfer tape when running. Especially, as to the elastic tongue piece of the transfer head, there are, besides a steeple shape one in which each tape running surface at a substrate surface side (upstream side) and a transfer tape discharge side (downstream side) is formed so as to be sharpened towards a tip (Japanese Patent Publication No. 11639/1991), one in which, in order that the not-yet-used transfer tape is surely and closely contacted with the substrate surface and pressure is surely transmitted to the transfer tape, a tape running surface of the substrate surface side is made as a curved surface while being sharpened towards the tip and a tape running surface at the used transfer tape discharge side is made flat, and one in which a tape running surface at the substrate surface side of the elastic tongue piece of the transfer head is made as a curved surface while being sharpened towards a tip and a tape running surface at the used transfer tape discharge side is also made as a curved surface both having a same radius of curvature while being sharpened towards the tip.

However, as to the above conventional transfer head, especially as to the elastic tongue piece thereof, when each tape running surface at a substrate surface side and a transfer tape discharge side is formed so as to be sharpened toward a tip, when the transfer tape is pushed and closely contacted from behind, a transferring surface of the elastic tongue piece is a completely flat surface, so that a contact with the substrate surface becomes a face contact. Thus a pressure exerted by a user is dispersed, thereby making it impossible to evenly transfer/apply a correction paint, etc. from the transfer tape to the substrate surface. Moreover, as to the steeple shape one, since its foremost portion is bent at an acute angle and plural bent points are generated depending on circumstances, if it is one producing a large resistance owing to the fact that a substance such as paste applied on a surface of the transfer tape adheres to the substrate surface, it may result in that the transfer tape running on the bent points of the steeple shape elastic tongue piece is folded, so that the transfer tape is prevented from being smoothly fed/wound under the influence of a running resistance exerted to the transfer tape and, further if the running resistance exerted to the transfer tape is excessively large, the transfer tape itself may be cut off. Moreover, in a tape running surface at the transfer tape discharge side, since there is no member for guiding a discharged transfer tape, the discharged transfer tape becomes liable to fluctuate vertically and horizontally, so that there is such a disadvantage that, in case where an application operation is continuously performed, the transfer tape is deviated from the tape running surface and, therefore, there is a problem that for a user the operation becomes very complex.

Further, when a tape running surface at the substrate surface side is made into a curved surface while being sharpened toward a tip and a tape running surface at the used transfer tape discharge side is made flat, since an area of the tape running surface at the substrate surface side becoming closely contacted to the substrate surface is certainly large, it is possible to evenly push the not-yet-used transfer tape from behind over a wide range, to surely and closely contact the transfer tape to the substrate surface, and to evenly and surely transfer/apply the correction paint or the paste applied to its surface to the substrate surface. However, similarly to the foregoing steeple shape one, if a large resistance is produced owing to the fact that a substance such as paste applied on a surface of the transfer tape adheres to the substrate surface, it becomes impossible that the used transfer tape, in combination with a resistance generated by the fact that the used transfer tape is folded at a tip of the elastic tongue piece being made a starting point, is smoothly run in a direction towards a winding reel of a transfer tape feeding/winding mechanism contained in an applicator body, so that there is a fear that a smooth operation for transferring/applying a paste or correction paint cannot be performed.

Further, in case where the transfer head, especially the elastic tongue piece is one in which a tape running surface at the substrate surface side of the elastic tongue piece of the transfer head is made into a curved surface while being sharpened toward a tip and a tape running surface at the used transfer tape discharge side is also made into a curved surface with both having a same radius of curvature while being sharpened toward the tip, it follows that the used transfer tape runs while being guided by a surface of the elastic tongue piece of the transfer head, so that a fluctuation of the transfer tape on the tape running surface at the side discharging the transfer tape can be prevented. However, since a large resistance is generated when the transfer tape runs on the tape running surface at the discharge side through the tape running surface at the substrate surface side and since, even if the tape running surface at the used transfer tape discharge side is sharpened toward a tip with the same radius of curvature as the curved surface on the tape running surface at the substrate surface side, its shape is also sharpened at a foremost end, of the elastic tongue piece of the transfer head, connecting the tape running surface at the substrate surface side to the tape running surface of the discharge side, it follows that the used transfer tape is folded similarly to the foregoing one, so that a large resistance is generated and, therefore, there is still a fear that a smooth running of the transfer tape at the transfer head is hindered.

Further, there is proposed an applicator in which a transfer head is provided with an elastic pushing body capable of being elastically deformed by a force exerted thereon when transferring, each corner portion of the elastic pushing body is formed into an arc-like surface and, further, one of the corner portions is formed so as to have a larger radius of curvature than the other corner portion (Japanese Utility Model Registration No. 2551137). And, certainly it becomes one which can evenly transfer/apply a correction paint, etc. by the fact that the transfer tape is pushed and closely contacted onto the substrate surface from behind by the one arc-like surface corner portion having a smaller radius of curvature and which can surely transfer/apply the correction paint, etc. of the transfer tape surface to the substrate surface only for a required portion because the correction paint, etc. of the transfer tape surface is evenly cut by the fact that a pressure is applied to the transfer tape by the other arc-like surface corner portion having the larger radius of curvature, and it follows that, since a discharge of the used transfer tape is performed at the arc-like surface portion, it is smoothly discharged in comparison with the foregoing one in which a shape of the foremost end of the elastic tongue piece is sharpened. However, if it is attempted to evenly cut the correction paint, etc. of the transfer tape surface by exerting a pressure to the transfer tape via the other arc-like surface corner portion having the larger radius of curvature, it is unavoidable to further enlarge the radius of curvature in order to surely cut the correction paint of the transfer tape surface at an application operation complete position and, as a result, a resistance occurs in running of the transfer tape, so that there is a fear that a smooth transferring/applying operation cannot be performed.

SUMMARY OF THE INVENTION

Therefore, it is an object of the invention to provide an applicator which can solve the problems inherent to the foregoing conventional applicators. In particular it is an object of the invention to provide an applicator which can rapidly and surely perform an operation of transferring/applying a transfer material like a correction paint, etc. onto a substrate surface by surely pushing the transfer tape onto the substrate surface for closely contacting it therewith. Still another object of the invention is to provide an applicator by which a feeding/winding of the transfer tape is effected in a smooth and sure manner.

According to the invention, there is provided an applicator comprising an applicator body containing therein a transfer tape feeding/winding mechanism for feeding not-yet-used transfer tape having on a surface thereof a transfer material from a supply reel towards a winding reel for accomodating used transfer tape, and a transfer head protruding from said applicator body and having a tip around which the tape is guided during its travel from the supply reel to the winding reel for transferring the transfer material from the transfer tape onto a substrate surface, said tip being formed on an elastic tongue piece held in said applicator body, wherein said tip having a curved downstream tape running surface whose radius of curvature is between 0.75 and 1.5 mm and a curved upstream tape running surface whose radius of curvature is between 1.5 and 2.5 mm. For providing a continuously curved tape running surface of the tip the curved downstream and upstream tape running surfaces can be smoothly and continuously connected with each other or as an alternative the curved downstream and upstream tape running surfaces are arranged to contact each other along a contacting line which is covered by a seal tape forming a seal tape running surface.

Since the applicator of the invention is built in such a manner as mentioned above, by the fact that a tip of the elastic tongue piece protruding from the applicator body and constituting the transfer head together with guide plates is made in such a manner that a tape running surface at a side from which the used transfer tape is discharged toward a winding reel direction, i.e., a discharge or downstream surface, has a curved surface whose radius of curvature is between 0.75 and 1.5 mm, and a tape running surface at a side through which the not-yet-used transfer tape is supplied toward a tip direction, i.e., a transfer or upstream surface, has a curved surface whose radius of curvature is between 1.5 and 2.5 mm, it is possible to enlarge a surface for pushing and closely contacting the not-yet-used transfer tape onto the substrate surface, so that it is possible to evenly transfer/apply the transfer material, i.e. a correction paint or a paste, etc. on a substrate surface. Incidentally, if the radius of curvature of the transferring surface forming the tip of the elastic tongue piece of the transfer head is made less than 1.5 mm, an area of the transferring surface becomes too small, so that an operation for evenly transferring/applying the correction paint and the paste, etc. becomes difficult. On the other hand, if the radius of the curvature is made larger than 2.5 mm, an area of the transferring surface becomes excessively large, so that an even transferring/applying operation cannot be performed.

Further, in the tip of the elastic tongue piece constituting the transfer head together with guide plates, by the fact that a tape running surface at a side from which the used transfer tape is discharged toward a winding reel direction, i.e., a discharge surface , has a curved surface whose radius of curvature is between 0.75 and 1.5 mm, the used transfer tape is guided/run along the discharge surface forming the tip of the elastic tongue piece. Therefore, as to the transfer tape sent out of the applicator body and accommodated again into the applicator body through the transfer head, a resistance accompanying its run becomes small, so that it is smoothly wound/accommodated on a winding reel of a transfer tape feeding/winding mechanism contained in the applicator body. Incidentally, if the radius of curvature of the discharge surface forming the tip of the elastic tongue piece of the transfer head is made less than 0.75 mm, the curved surface of the discharge surface of the elastic tongue piece becomes excessively sharpened, so that a running resistance of the transfer tape becomes large and, therefore, a smooth transferring/applying operation cannot be performed. On the other hand, if the radius of the curvature is made larger than 1.5 mm, the curved surface of the discharge surface of the elastic tongue piece becomes blunt, so that there is a fear that the correction paint or the paste, etc. of the transfer tape surface cannot be surely cut.

And furthermore, by the fact that the transferring surface and the discharge surface of the elastic tongue piece are connected by a smoothly and continuously curved surface, it is possible to further reduce the running resistance of the transfer tape, thereby making the feeding/winding of the transfer tape smoother.

DESCRIPTION OF THE PREFERRED EMBODIMENT

Figure 1:
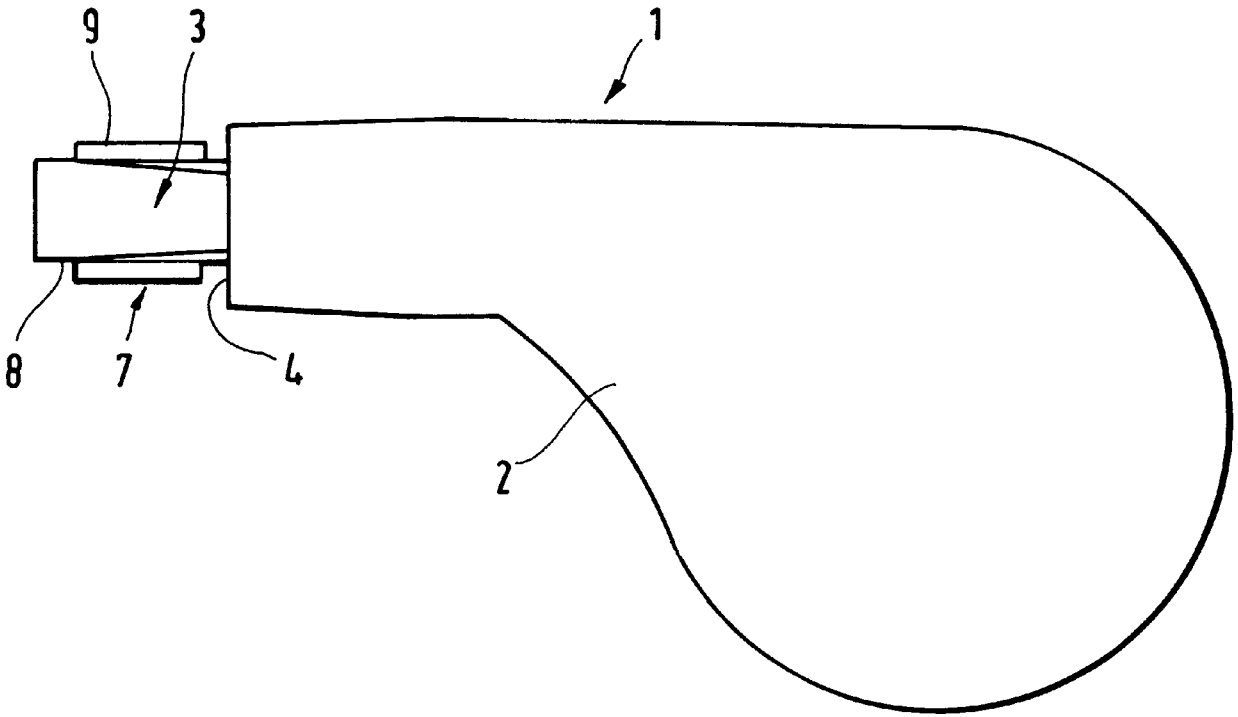
FIG. 1 is a front view of an applicator in accordance with an embodiment of the invention.
Figure 2:
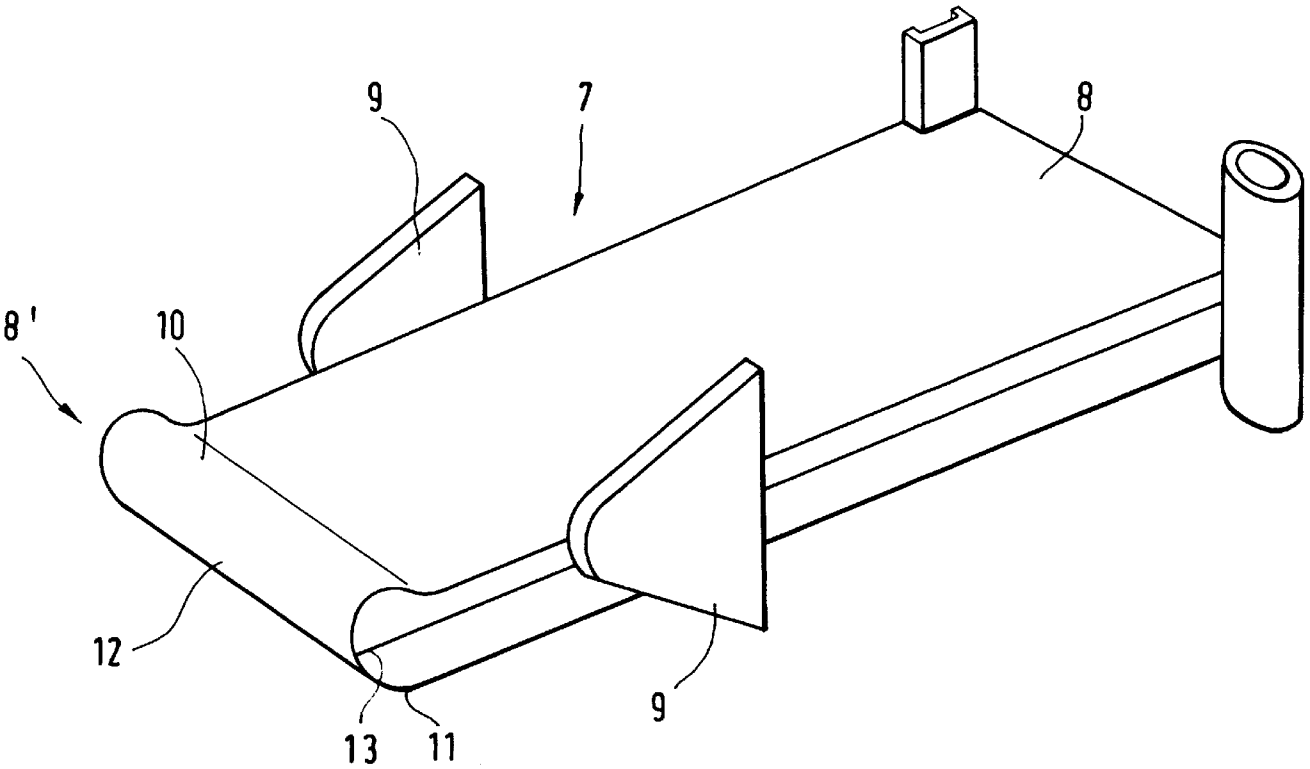
FIG. 2 is an enlarged perspective view of a transfer head of the applicator.
Figure 3:
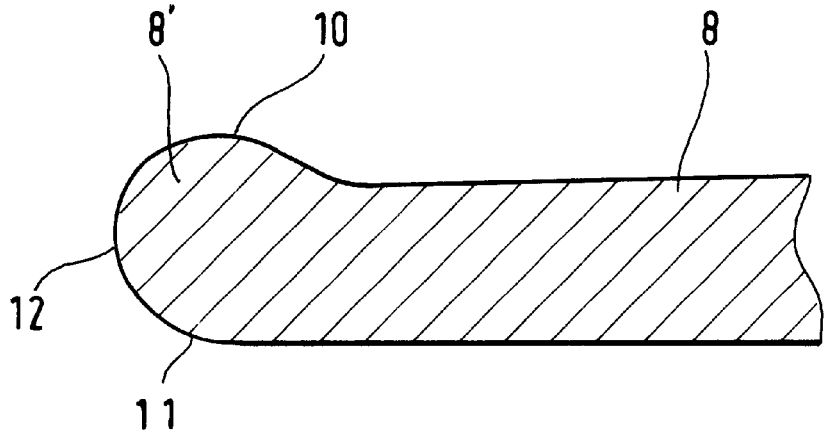
FIG. 3 is a longitudinally sectioned enlarged side view of a main portion of the transfer head.
Figure 4:
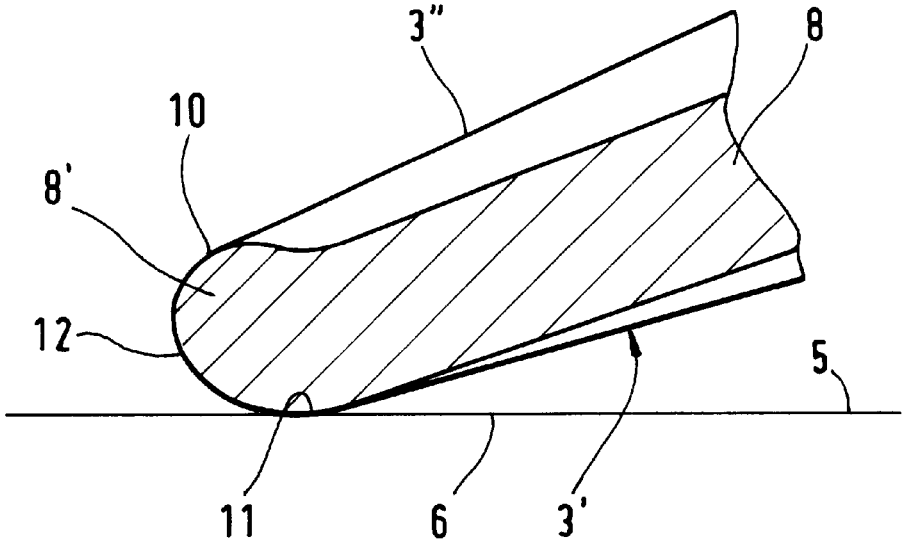
FIG. 4 is a view similar to FIG. 3 showing the main portion of the transfer head during using of the applicator.

The invention is further described with reference to an embodiment thereof and the drawings. Numeral 1 denotes an applicator according to the invention. The applicator 1 comprises an applicator body 2 containing therein a transfer tape feeding/winding mechanism for feeding a not-yet-used tape 3' from a supply in the form of a so-called pancake in which the not-yet-used tape 3' carries on its surface a correction paint or a paste, etc. for winding/accommodating a tape 3" after use on a winding reel. The applicator 1 further comprises a transfer head 7 which is held in the applicator body 2 and protrudes from an opening portion 4 of the applicator body 2. A transfer of the correction paint or the paste, etc. presenton a surface 5 of the not-yet-used tape 3' can be effected by pushing and closely contacting the not-yet-used tape 3' having on the surface 5 the correction paint or the paste, etc. onto a substrate surface 6 from behind.

The transfer head 7 protruding from the opening portion 4 of the applicator body 2 comprises an elastic tongue piece 8 for pushing and closely contacting the not-yet-used tape 3' with the substrate surface 6 from behind, and guide plates 9 for preventing fluctuations of the transfer tape 3 when running. A tip 8' of the elastic tongue piece 8 is made in such a manner that a tape running surface at a side from which the used transfer tape 3" is discharged toward a winding reel direction, i.e., a discharge or downstream surface 10, is a curved surface whose radius of curvature is between 0.75 and 1.5 mm, and a tape running surface at a side through which the not-yet-used transfer tape 3' is supplied toward a tip direction, i.e., a transferring or upstream surface 11, has a curved surface whose radius of curvature is between 1.5 and 2.5 mm, preferably 1.8 and 2.3 mm. In addition to this, in the applicator 1 the curved surfaces 10 and 11 are connected by a smoothly and continuously curved surface, i.e., a tip curved surface 12.

Since the applicator 1 which is an embodiment of the invention has the above-mentioned construction, in case where the applicator 1 is used by a user in order to transfer/apply a correction paint or the paste, etc. unto the substrate surface 6, by the facts that the tip 8' of the elastic tongue piece 8 is made in such a manner that a tape running surface at a side from which the used transfer tape 3" is discharged toward a winding reel direction, i.e., the discharge surface 10, is a curved surface whose radius of curvature is between 0.75 and 1.5 mm, and a tape running surface at a side through which the not-yet-used transfer tape 3' is supplied toward a tip direction, i.e., the transferring surface 11, is a curved surface whose radius of curvature is between 1.5 and 2.5 mm, preferably 1.8 and 2.3 mm, and additionally that the curved surfaces 10 and 11 are connected by a smoothly and continuously curved surface, i.e., a tip curved surface 12, the transferring surface 11 closely contacting with the substrate surface 6 is caused to have a curved surface whose radius of curvature is between 1.5 and 2.5 mm, preferably between 1.8 and 2.3 mm, so that it follows that a surface for pushing and closely contacting the not-yet-used transfer tape 3' onto the substrate surface 6, i.e., the transferring surface 11, can be enlarged, thereby making it possible to evenly transfer/apply the correction paint or the paste, etc. on the surface 5 of the transfer tape 3 over a wide range.

Further, by the fact that the discharge surface 10 at the tip 8' of the elastic tongue piece 8 is a curved surface whose radius of curvature is between 0.75 and 1.5 mm, the used transfer tape 3" is guided/run along the discharge surface 10 forming the tip 8' of the elastic tongue piece 8. Further, the curved surfaces 11 and 10 are smoothly and continuously connected with each other by a curved surface, i.e., the tip curved surface 12. Consequently as to the transfer tape 3 fed from an inside of the applicator body 2 and accommodated again into applicator body 2 through the transfer head 7, a running resistance does not occur in the elastic tongue piece 8 of the transfer head 7, so that it is smoothly wound/accommodated on the winding reel of the transfer tape feeding/winding mechanism contained in the applicator body 2.

Incidentally, in order to make, together with the transferring surface 11 and the discharge surface 10, the tip 8' of the elastic tongue piece 8 into one having the tip curved surface 12 smoothly connecting the curved surfaces 11 and 10, the transferring surface 11 and the discharge surface 10 are contacted with each other along a contacting line 13 in which the contacting line 13 can be covered by a seal tape (not shown) having a smooth surface such as a seal tape made of a plastics material like Teflon, thereby using a seal tape surface portion as the tip curved surface 12 smoothly connecting the transferring surface 11 and the discharge surface 10 with each other.

As an alternative the curved surfaces 10, 11 can be connected with each other in a manner to provide a smoothly and continuously curved surface 12 which makes it possible to evenly push and closely contact the correction paint or the paste, etc. on the surface of the transfer tape with the substrate surface over a wide range and to smoothly discharge the used transfer tape to the discharge surface, so that there is brought about an excellent effect that a user can continuously, rapidly and surely perform an operation for transferring/applying the correction paint or the paste, etc.

What is claimed is:

1. An applicator for transferring a transfer material from a transfer tape carrying the transfer material to a substrate surface comprising an applicator body containing therein a transfer tape feeding/winding mechanism for feeding not-yet-used transfer tape having on a surface thereof the transfer material from a supply reel towards a winding reel for accomodating used transfer tape, and a transfer head protruding from said applicator body and having a tip around which the transfer tape is guided during its travel from the supply reel to the winding reel for transferring the transfer material from the transfer tape onto the substrate surface, said tip being formed on an elastic tongue piece held in said applicator body, wherein said tip having a curved downstream tape running surface whose radius of curvature is between 0.75 and 1.5 mm and a curved upstream tape running surface whose radius of curvature is between 1.5 and 2.5 mm.

2. An applicator as set forth in claim 1, wherein said curved downstream and upstream tape running surfaces are smoothly and continuously connected with each other for providing a continuously curved tape running surface of the tip.

3. An applicator as set forth in claim 1, wherein said curved downstream and upstream tape running surfaces contact each other along a contacting line, said contacting line being covered by a seal tape forming a seal tape running surface for providing a continuously curved tape running surface of the tip.

* * * * *